US005600990A

United States Patent [19]

Kelly et al.

[11] Patent Number: 5,600,990

[45] Date of Patent: Feb. 11, 1997

[54] METAL EXTRUSION DIE STACK AND METHOD

[75] Inventors: L. William Kelly, Beaver Falls; Edward G. Zinser, Coraopolia; Willard S. Foster, Enon Valley, all of Pa.

[73] Assignee: P.M.A.C., Ltd., Houston, Tex.

[21] Appl. No.: 495,799

[22] Filed: Jun. 27, 1995

[51] Int. Cl.[6] ..... B21C 23/00

[52] U.S. Cl. ..... 72/255; 72/253.1

[58] Field of Search ..... 72/253.1, 254, 72/255, 257, 272, 273

[56] References Cited

U.S. PATENT DOCUMENTS

| | | | |
|---|---|---|---|
| 2,385,144 | 9/1945 | Lorant | 72/255 |
| 2,539,564 | 1/1951 | Barrett | 72/255 |
| 2,736,429 | 2/1956 | Sejournet et al. | 72/255 |
| 2,738,062 | 3/1956 | Edgecombe | 207/1 |
| 2,869,227 | 1/1959 | Bradstreet | 29/424 |
| 3,522,721 | 8/1970 | Whiting | 72/255 |
| 5,019,114 | 5/1991 | Gronbaek | 72/467 |
| 5,103,664 | 4/1992 | Guidash | 72/272 |
| 5,350,560 | 9/1994 | Kasiske | 420/38 |
| 5,366,138 | 11/1994 | Vela et al. | 228/176 |

FOREIGN PATENT DOCUMENTS

| | | | |
|---|---|---|---|
| 0627322 | 9/1961 | Canada | 72/255 |
| 1452341 | 2/1969 | Germany | 72/255 |
| 0006387 | 3/1968 | Japan | 72/255 |
| 0423537 | 4/1974 | U.S.S.R. | 72/255 |
| 0593711 | 10/1947 | United Kingdom | 72/255 |

*Primary Examiner*—Lowell A. Larson
*Assistant Examiner*—Ed Tolar
*Attorney, Agent, or Firm*—Charles D. Gunter, Jr.

[57] ABSTRACT

A steel extrusion apparatus is shown having an improved die stack with a direct cone geometry. The die stack includes a die holder with removable and replaceable die inserts. The die inserts are made from a high strength material while the die holder is made of a less expensive, traditional material. A hot metal billet is extruded through an orifice provided in the die insert of the die holder. The die stack assembly is retained as an assembled unit as the extrusion container is moved out of contact with the assembly and the butt end of the metal billet is discarded. The die stack assembly is then again located on the extrusion container as a unit to begin another extrusion cycle.

5 Claims, 2 Drawing Sheets

METAL EXTRUSION DIE STACK AND METHOD

BACKGROUND OF THE INVENTION

1. Field of the Invention

The present invention relates generally to metal extrusion processes and to metal extrusion dies for use therein and, more specifically, to an improved metal extrusion die stack having a direct cone geometry.

2. Description of the Prior Art

In metal extrusion processes, the metal work piece is subjected to heat and pressure, by the application of dies, to form the metal work piece into a desired shape. The appropriate work surfaces of the dies contact the work piece under great pressures such as to force the metal work piece through the die orifice or orifices. Also, the work piece is ordinarily preheated to an appreciable extent to make it more easily deformable under the pressures employed. Thus, in typical extrusion processes, a block or billet of metal at elevated temperature is forced under high pressure to flow through a die having an opening which corresponds to the desired cross-sectional shape of the extrusion to be produced. The metal may be heated in the range of 2300° F., in the case of steel, during the extrusion process.

U.S. Pat. No. 2,738,062, issued Mar. 13, 1956, to Edgecombe, is typical of the prior art extrusion processes in showing an extrusion press in which a front and rear platen are held in accurately spaced relation with one another. Between the platens is mounted a billet container for movement toward and away from the forward platen. The rear platen supports a ram arranged to project into the container and force a billet therein to flow through the die. The die is mounted in a die holder which is releasably engaged in a die carrier aligned with the container passage. The carrier is mounted for movement into and out of the forward platen to move the die into and out of operative relation with the exit or downstream end of the container.

In order to form an extrusion, the container is moved forwardly to seat against the rear face of the forward platen. A die holder and die assembly is meanwhile mounted on the rear face of the carrier and the latter is moved rearwardly into the forward platen to engage the die in a recess in the forward end of the container which is coaxial with the container passage. The carrier is then locked to the forward platen. After a heated billet has been loaded into the container, the ram, carrying a dummy block on its outer end, is moved forwardly under high pressure to force the billet outwardly through the die. The extrusion is then severed and conveyed away from the press.

Even though plain and alloy steels have been extruded successfully for over 40 years, a need exists for an improved steel extrusion apparatus and method which solves many of the difficulties associated with the high temperatures and pressures encountered with steel extrusion processes.

A need exists for such an apparatus and method which includes an improved metal extrusion die stack with removable die inserts which can be easily and more economically changed out in the event of wear.

A need also exists for such a metal extrusion die stack which features an improved die stack geometry of a simple design which saves steps in the prior art extrusion process.

A need also exists for an ultra high strength material which performs well under the extreme temperatures and pressures required in steel extrusion and which reduces die erosion, distortion and fracture.

A need also exists for an improved metal extrusion die stack with a direct cone geometry which facilitates the rapid changing of dies.

SUMMARY OF THE INVENTION

The metal extrusion apparatus of the invention includes a billet container having a generally cylindrical interior for receiving a metal billet to be extruded. The billet container has a tapered front opening and a rear opening. A ram is received within the rear opening of the container for forcing the metal billet forward in the direction of the front opening.

A generally planar die holder is provided having a front, working surface and a rear surface and having a bevelled die opening therein which communicates the front and rear surfaces. The die holder also has a tapered, peripheral lip. A generally planar die insert is received within the die opening of the die holder. The die insert has at least one opening or orifice for extruding metal from the container as the ram moves forward. The die insert also has an outer peripheral edge which has a complimentary bevel to that of the bevelled die opening in the die holder.

A retaining ring is received within the tapered front opening of the billet container. The retaining ring has a generally planar front surface, a generally planar rear surface, and a tapered interior profile which is complimentary to the tapered, peripheral lip of the die holder for receiving the die holder. The retaining ring also has a tapered exterior profile which is complimentary to the tapered front opening of the billet container.

A generally planar backer plate is received within the tapered interior profile of the retaining ring. The backer plate has a rear face and has a front face which is closely received against the rear face of the die holder when the die holder is inserted within the retaining ring. The backer plate has an extrusion opening for receiving metal which is extruded through the orifice of the die insert. The tapered interior profile of the retaining ring increases an internal diameter from the front surface to the rear surface thereof, providing a direct cone geometry for the apparatus.

The bevelled die opening in the die holder also increases an internal diameter from the front, working surface to the rear surface thereof. The extrusion opening in the backer plate is preferably larger than the orifice provided in the die insert. Preferably, the die holder is made of a heat resistant tool steel while the die insert is made of a modified, ultra high strength Stellite alloy.

In the method of the invention, the extrusion die stack is made up of multiple components in contact with the container and ram for extruding the metal billet. The components of the extrusion die stack have a direct cone geometry. The metal billet is extruded through the extrusion die stack until only a butt end of the billet remains in the chamber of the extrusion apparatus. The extrusion billet container is then moved out of contact with the die stack. The extruded metal is then cut from the butt end and the butt end is used to eject the extrusion from the die stack.

Additional objects, features and advantages will be apparent in the written description which follows.

DETAILED DESCRIPTION OF THE INVENTION

Figure 1:
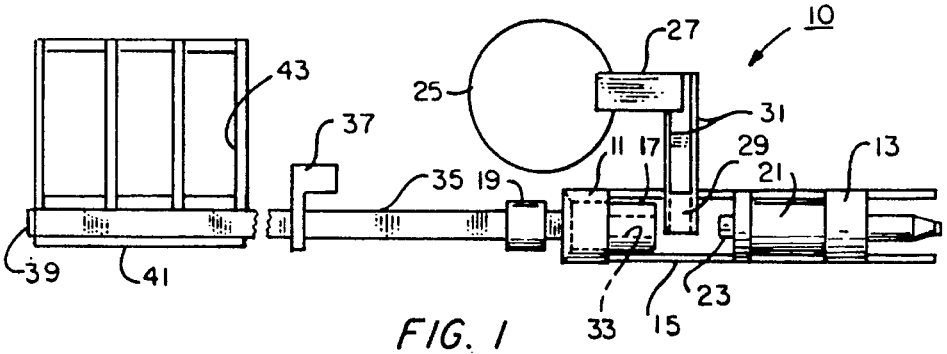
FIG. 1 PRIOR ART
FIG. 1 is a schematic, plan view of a prior art extrusion press and associated billet and extrusion handling and processing components.

FIG. 1 shows a prior art extrusion press, designated generally as 10. The press 10 is described, for example, in issued U.S. Pat. No. 2,738,062, issued Mar. 13, 1956, the disclosure of which is incorporated herein by reference. As shown in FIG. 1, the extrusion press 10 includes a front platen 11, a rear platen 13 rigidly tied to platen 11 by tie rods 15, a container 17 having limited longitudinal movement relative to the platens, a die carrier 19 moveable into and out of front platen 11, and a ram assembly 21 having a ram 23 projectable into container 17. The billets to be extruded are heated to a high temperature, for example, 2300° F., in the case of steel, in a heating means such as rotary heater 25. The billets are charged into the heating means 25 and extracted therefrom by a suitable billet handling device 27. This device deposits the heated billets onto a transfer car 29, operating on tracks 31, which carries the billets into alignment with passage 33 of container 35 and ejects them into this passage.

Ram 23 is projected into passage 33 to engage the billet and force it, under high pressure, through a die mounted on the rear face of carrier 19 and held thereby against the exit end of the container passage 33, carrier 19 being locked into forward platen 11 and thus held against movement relative to the two platens 11 and 13. Following the extrusion movement of the ram, the latter is withdrawn and container 17 moved rearwardly a short distance away from platen 11. The extrusion is then severed between the container and front platen, after which container 17 is moved forwardly and the extrusion withdrawn by runout table and conveyer 35. Ram 23 is then moved into container 17 to eject the severed end, or discard, of the extrusion, this discard moving into platen 11 and falling into a suitable receptacle.

Meanwhile, conveyer 35 moves the extrusion forwardly beneath a saw 37. The latter severs the extrusion into the required handling lengths and the cut sections are moved forwardly against a stop 39. At this point, a pusher 41 moves the sections laterally from the conveyer 35 onto skids 43 for storage or further handling.

Figure 2:
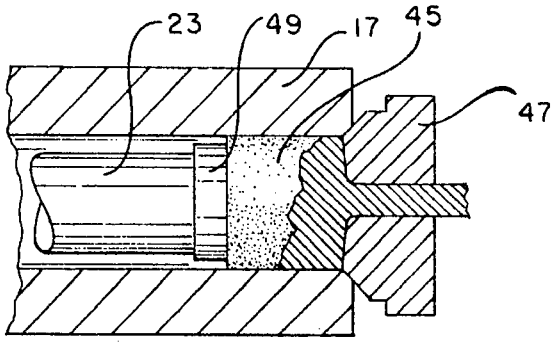
FIG. 2 PRIOR ART
FIG. 2 is a partial, cross-sectional view of the prior art extrusion press showing the billet container, extrusion die and ram being used to extrude the hot metal billet through the die orifice.

FIG. 2 is an isolated view of the container 17 and ram 23 being used to extrude a hot metal billet 45 through a prior art die 47. The ram 23 is separated by a blank or disk 49 from the butt end of the billet 45. Several deficiencies existed with the prior art arrangement. If an exotic material was used for the die 47 and the entire die was formed of the material, it was generally very expensive or cost prohibitive. If less expensive material was used for the die 47, the die was more prone to erosion, distortion and fracture. Other problems existed, as well, as will be presently apparent.

Figure 3:
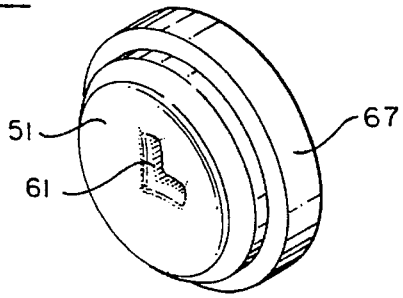
FIG. 3 is a front, perspective view of the improved die stack of the invention.
Figure 4:
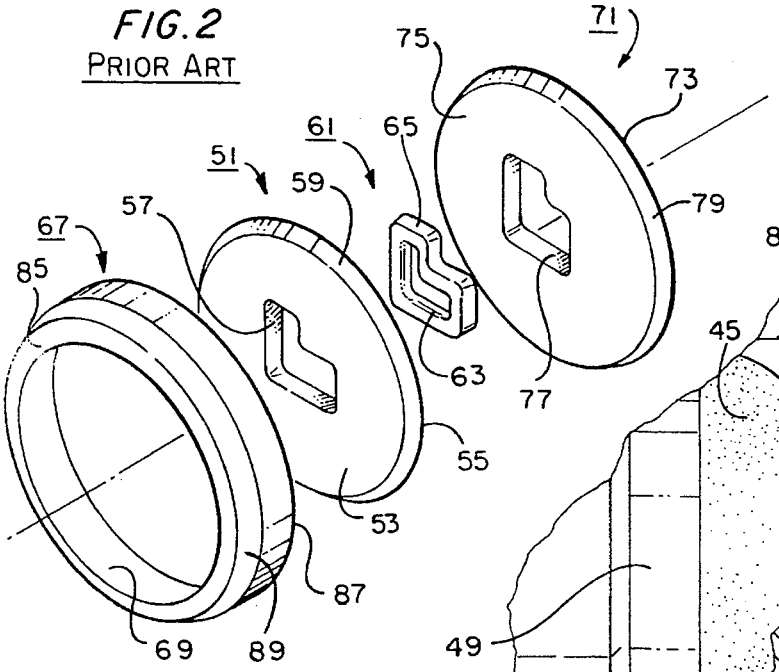
FIG. 4 is an exploded view of the die stack of FIG. 3 showing the components thereof.

FIGS. 3 and 4 show the improved die stack arrangement of the invention. As shown in FIG. 4, the improved metal extrusion die stack includes a generally planar die holder 51 having a front, working surface 53, a rear surface 55 and a bevelled die opening 57 therein which communicates the front and rear surfaces. The die holder 51 also has a tapered, peripheral lip 59.

A generally planar die insert 61 is received within the die opening 57 of the die holder. The die insert has at least one opening or orifice 63 for extruding metal and has an outer peripheral edge 65 which has a complimentary bevel to that of the bevelled die opening 57 in the die holder 51.

A retaining ring 67 is provided for receiving the die holder 51. The retaining ring has a tapered interior profile 69 which is complimentary to the tapered, peripheral lip 59 of the die holder 51.

A generally planar backer plate 71 is provided having a rear face 73 and having a front face 75 which is closely received against the rear face 55 of the die holder 51 when the die holder 51 is inserted within the retaining ring 67. The backer plate 71 has an extrusion opening 77 for receiving metal which is extruded through the orifice 63 of the die insert 61. The backer plate also has a tapered peripheral lip 79 which is adapted to engage the tapered interior profile 69 of the retaining ring 67 in complimentary fashion when the die stack is assembled in the completed form shown in FIG. 3.

Figure 5:
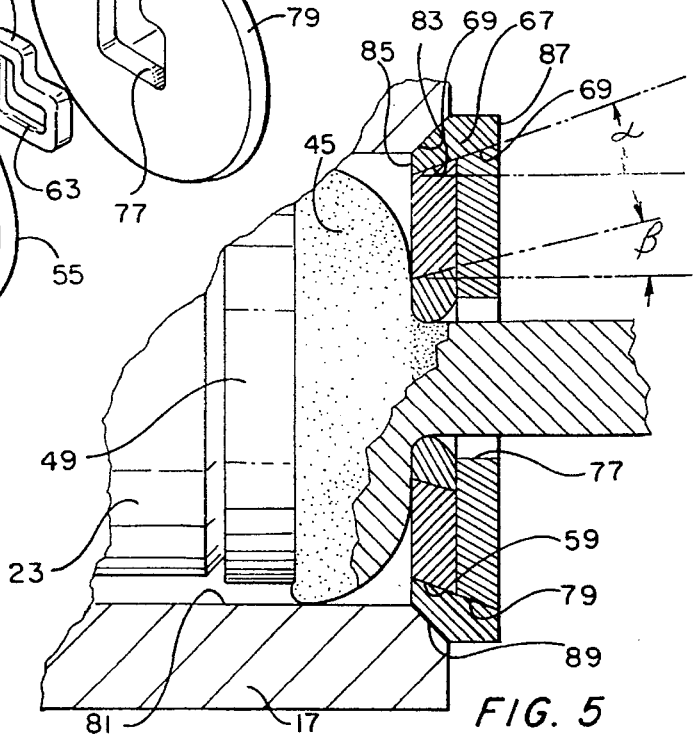
FIG. 5 is a partial, cross-sectional view of the die stack of the invention in place on a billet container showing the ram being used to extrude the hot metal billet through the die orifice.

As is best seen in FIG. 5, the die stack arrangement of the invention has a "direct cone" geometry. Thus, the container 17 has a generally cylindrical interior 81 for receiving a metal billet 45 to be extruded and has a tapered front opening 83 and a rear opening (not shown). The retaining ring 67 (FIG. 4) has a generally planar front surface 85, a generally planar rear surface 87 and a tapered exterior profile 89 which is complimentary to the tapered front opening 83 of the billet container 17.

As best seen in FIG. 5, the tapered interior profile 69 of the retaining ring 67 increases in internal diameter from the front surface 85 to the rear surface 87 thereof. The angle $\alpha$ in FIG. 5 is an acute angle, for example, in this case approximately 20°. The tapered peripheral lip 59 of the die holder and the tapered peripheral lip 79 of the backer plate are both tapered at an angle to allow these components to be tightly received within the interior profile of the retaining ring. The bevelled die opening 57 of the die holder 51 also increases in internal diameter from the front, working surface 53 to the rear surface 55 thereof. The angle $\beta$ in FIG. 5 is approximately 15°. The extrusion opening 77 in the backer plate 71 is larger than the opening or orifice 63 provided in the die insert 61. In the assembled form show in FIG. 3, the die holder and backer plate are successively received within the retaining ring 67 with the peripheral lips 59, 79 giving each of these components a gradually increasing outer diameter so that the components stack much like drinking cups, one atop the other. As viewed in FIG. 5, the adjoining peripheral lips 59, 79 form a continuous, smooth slope of increasing cross-sectional diameter.

Preferably, the die holder 51 is made of a less expensive, heat resistant tool steel and the die insert 61 is made of an ultra high strength alloy. The chemistry of the ultra high strength alloy performs extremely well under the extreme temperatures and pressures required in steel extruding. The working conditions for steel and alloy steel extrusions are typically on the order of 2300° F. and 1–5 million pounds of force. A particularly preferred material for the die inserts is a modified Stellite alloy which is characterized by the substantial absence of molybdenum as shown in the following table:

| MODIFIED STELLITE 6B WITHOUT Mo | | |
|---|---|---|
| ELEMENT | HIGH | LOW |
| Al | 0.4 | .10 |
| Mo | TRACE | TRACE |
| Mn | .80 | .60 |
| Fe | 10.00 | 3.00 |
| Ni | .25 | .00 |
| Cr | 27.00 | 23.00 |
| Si | 5.00 | .00 |
| C | .70 | .50 |
| Co | 60.00 | 50.00 |
| W | 5.50 | 4.50 |

RC 44–45 AVERAGE

Since the ultra high strength material of the die inserts is more expensive to produce, its economic use is accomplished by making small, light weight inserts of the ultra high strength material, as opposed to solid, round dies of the prior art. The inserts fit into the reusable die holders 51 with the inside geometry of each insert being configured to form the actual orifice of the die stack. The inserts are easily retrieved for reuse or refurbishment and the direct cone geometry of the die stack facilitates a tight fit between each of the components and the backup tooling for greater strength of the assembly as a whole. The direct cone geometry also saves time and effort during the extrusion process, as will be more fully explained.

Figure 6:
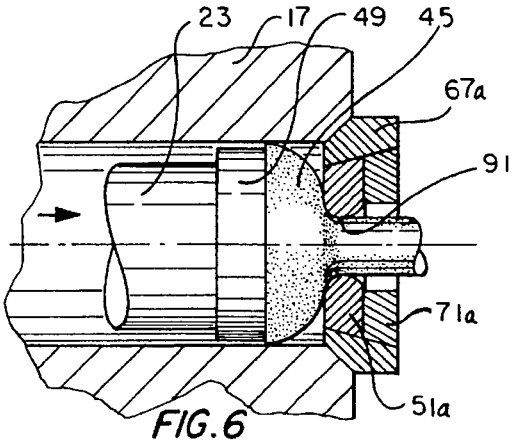
FIGS. 6–9 are simplified partial, cross-sectional views of the metal extrusion apparatus of the invention showing the method steps employed in extruding the hot metal billet through the orifice of the die stack where the die stack has a direct cone geometry.

FIGS. 6–9 illustrate, in simplified schematic fashion, the steps of the method of the invention utilizing a die stack with direct cone geometry. The die stack illustrated in FIGS. 6–9 does not utilize a replaceable insert in a die holder, as in the embodiment of FIG. 5, but illustrates the advantage of a direct cone geometry which can be realized whether or not die inserts are utilized. As shown in FIG. 6, the ram 23 moves in a forward direction (to the right in FIG. 6) and acts against the dummy or blank disk 49 to force the hot metal billet 45 to be extruded through the die opening 91 in the die plate 51*a*. A backer plate 71*a* is received directly behind the die plate 51*a* within the retaining ring 67*a*.

Figure 7:
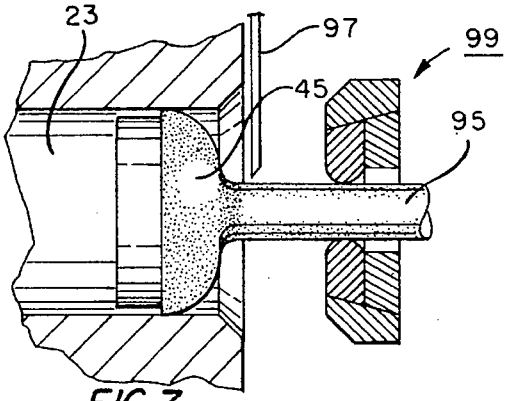
Figure 8:
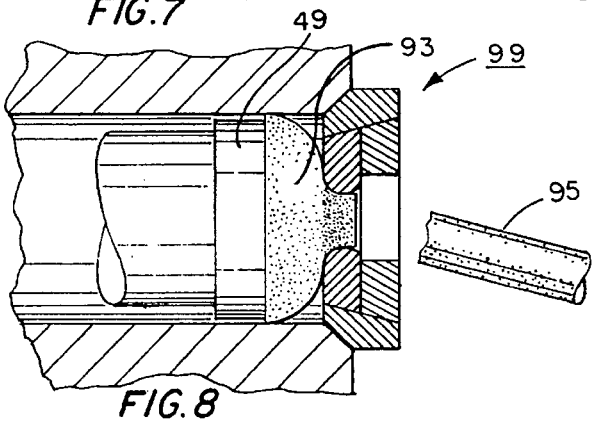
Figure 9:
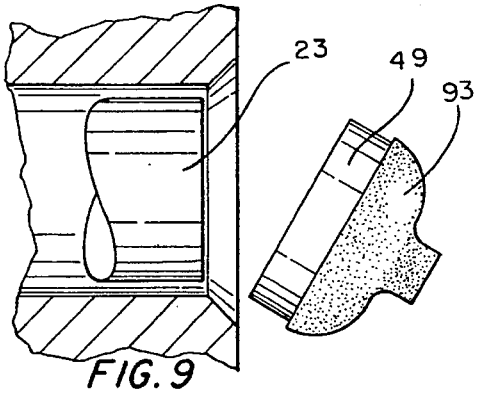

As shown in FIG. 7, the metal billet 45 is extruded through the extrusion die 51*a* until only a butt end of the metal billet remains in the chamber 17 of the extrusion apparatus. The extrusion billet container is then moved out of contact with the die stack, as shown in FIG. 7, and the extruded metal 95 is cut by means of saw 97. As shown in FIGS. 8 and 9, because the container 17 can be moved into or out of contact with the direct cone geometry die stack 99 with the die stack 99 remaining as a unit, it is possible to discard only the butt end 93 and blank 49 while retaining all of the components of the extrusion die stack to begin another extrusion cycle.

The direct cone geometry of the die stack also allows the butt end 93 to be used to eject the extrusion from the die stack. As shown in FIG. 8, the operator moves the container (with the butt end 93 still firmly pressed into the container) toward the die stack 99. The butt end at this point in the process has protrusions of the same geometry the extrusion or extrusions. As the container 17 moves toward the die stack 99, the butt end 93 forces the extrusion or extrusions 95 through the die stack 99, allowing the extrusions to be conveyed away from the extrusion press. The butt end 93 (FIG. 9) is then forced the entire way out of the container 17 by means of ram 23 and discarded.

Figure 10:
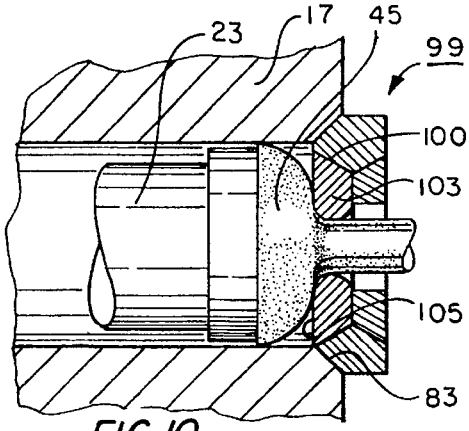
FIGS. 10–12 are similar views of the steps employed in extruding a hot metal billet through the orifice of a die stack where the die stack features a reverse cone geometry.
Figure 11:
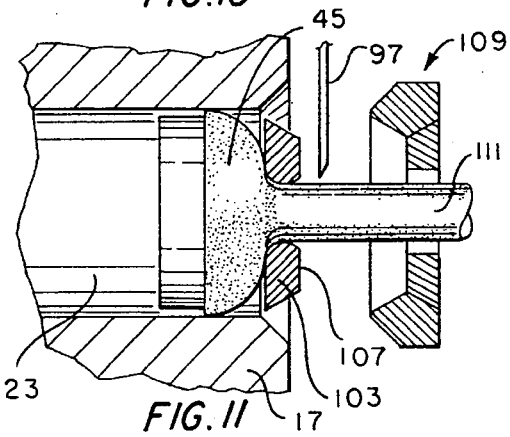
Figure 12:
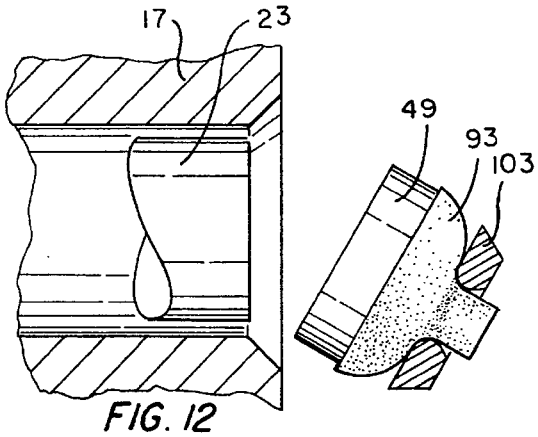

FIGS. 10–12 show a reverse cone extrusion die stack arrangement 99 which is in place against the tapered front opening 83 of the container 17. The tapered peripheral lip 101 of the die plate 103 shown in FIG. 10 is cut on an opposite angle to that of the die holder 51 and die plate 51*a* of the present invention. In other words, the external diameter of the die plate 103 gradually decreases moving from the front surface 105 to the rear surface 107 thereof.

As shown in FIG. 11, once the metal billet has been nearly completely extruded, a portion of the stack arrangement 109 is removed from the face of the container 17 so that the extrusion 111 can be cut by means of saw 97. Meanwhile, the die plate 103 is left behind in contact with the butt end 93 of the extrusion. As shown in FIG. 12, the ram 23 is then used to expel the blank 49 and butt end 93, along with the die plate 103 which falls into a suitable receptacle. The die plate 103 must be retrieved and conveyed, as by an elevator, for reassembly into the completed die stack to begin another extrusion cycle.

An invention has been provided with several advantages. The improved metal extrusion apparatus of the invention utilizes a die holder with removable and replaceable die inserts. The die insert can be economically manufactured of an ultra high strength alloy which helps prevent die erosion, distortion and fracture even when extruding steels and steel alloys. The die holder can be reused with the die inserts being replaced or removed and reworked as necessary. The direct cone geometry of the die stack saves steps during the extrusion process by facilitating the rapid changing of dies and also facilitates a tight fit between the die stack components and backup tooling for greater strength. Reverse cone geometry required the use of an extrusion pulling device to remove the extrusion from the press. The insert in such processes would remain on the butt end (discard piece), thus preventing the use of the butt end to eject the extrusion from the press. By using direct cone geometry, the insert is encapsulated and retrieved after every push, thereby enabling the use of the butt end as an ejector. Direct cone geometry thus allows for the rapid operation of the extrusion press. Dies can be removed and replaced between extrusion cycles in less than 30 seconds.

While the invention has been shown in only one of its forms, it is not thus limited but is susceptible to various changes and modifications without departing from the spirit thereof.

What is claimed is:

1. A metal extrusion apparatus, comprising:

a billet container having a generally cylindrical interior for receiving a metal billet to be extruded, the billet container having a tapered front opening and a rear opening;

a ram received within the rear opening of the container for forcing the metal billet forward in the direction of the front opening;

a permanent, generally planar die holder having a front, working surface and a rear surface and having an irregular shaped, bevelled die opening therein which communicates the front and rear surfaces, the die holder also having a generally round and tapered peripheral lip;

a consumable, generally planar die insert received within the die opening of the die holder, the die insert having at least one orifice which directly contacts the metal billet for extruding metal from the container as the ram moves forward, and having an outer peripheral edge which has a complimentary bevel and shape to that of the bevelled die opening in the die holder;

a round retaining ring contactable with the tapered front opening of the billet container, the retaining ring having a generally planar front surface, a generally planar rear surface and a tapered interior profile which is complimentary to the tapered, peripheral lip of the die holder for receiving the die holder and having a tapered exterior profile which is complimentary to the tapered front opening of the billet container;

a generally planar backer plate having a rear face and having a front face which is closely received against the rear face of the die holder when the die holder is inserted within the retaining ring, the backer plate having an extrusion opening for receiving metal which is extruded through the orifice of the die insert; and wherein the tapered interior profile of the retaining ring increases in internal diameter from the front surface to the rear surface thereof in gradually sloping fashion.

2. The metal extrusion apparatus of claim 1, wherein the bevelled die opening in the die holder increases in internal diameter from the front, working surface to the rear surface thereof.

3. The metal extrusion apparatus of claim 2, wherein the extrusion opening in the backer plate is larger than the orifice provided in the die insert.

4. A method of extruding a metal billet from an extrusion apparatus of the type which includes a billet container having a generally cylindrical interior for receiving the metal billet to be extruded and having a tapered front opening and a rear opening, the apparatus also having a ram received within the rear opening of the container for forcing the metal billet forward in the direction of the front opening, the method comprising the steps of:

mounting an extrusion die stack in cooperative relation with the container and ram for extruding the metal billet, the extrusion die stack having a direct cone geometry including a generally planar die holder provided with a front, working surface contactable by the metal billet and a rear surface and having an irregular shaped, bevelled die opening therein which communicates the front and rear surfaces, the die holder also being provided with a generally round and tapered peripheral lip;

installing a generally planar die insert within the die opening of the die holder, the die insert having at least one orifice which directly contacts the metal billet for extruding metal from the container as the ram moves the metal billet forward, and having an outer peripheral edge which has a complimentary bevel and shape to that of the bevelled die opening in the die holder;

installing a retaining ring within the tapered front opening of the billet container, the retaining ring having a generally planar front surface, a generally planar rear surface and a tapered interior profile which is complimentary to the generally round and tapered peripheral lip of the die holder for receiving the die holder and which increases in internal diameter from the front surface to the rear surface thereof, the retaining ring also being provided with a tapered exterior profile which is complimentary to the tapered front opening of the billet container;

installing a generally planar backer plate within the tapered interior profile of the retaining ring, the backer plate having a rear face and having a front face which is closely received against the rear face of the die holder when the die holder is inserted within the retaining ring, the backer plate having an extrusion opening for receiving metal which is extruded through the orifice of the die insert; and extruding metal through the orifice of the die insert by moving the ram against the metal billet in the container.

5. A method of extruding a metal billet from an extrusion apparatus of the type which includes a billet container having a generally cylindrical interior for receiving the metal billet to be extruded and having a tapered front opening and a rear opening, the apparatus also having a ram received within the rear opening of the container for forcing the metal billet forward in the direction of the front opening, the method comprising the steps of:

mounting an extrusion die stack in cooperative relation with the container and ram for extruding the metal billet, the extrusion die stack having a direct cone geometry including a generally planar die holder provided with a front, working surface contactable by the metal billet and a rear surface and having an irregular shaped, bevelled die opening therein which communicates the front and rear surfaces, the die holder also being provided with a generally round and tapered peripheral lip;

installing a generally planar die insert within the die opening of the die holder, the die insert having at least one orifice which directly contacts the metal billet for extruding metal from the container as the ram moves the metal billet forward, and having an outer peripheral edge which has a complimentary bevel and shape to that of the bevelled die opening in the die holder;

installing a retaining ring within the tapered front opening of the billet container, the retaining ring having a generally planar front surface, a generally planar rear surface and a tapered interior profile which is complimentary to the generally round and tapered peripheral lip of the die holder for receiving the die holder and which increases in internal diameter from the front surface to the rear surface thereof, the retaining ring also being provided with a tapered exterior profile which is complimentary to the tapered front opening of the billet container;

installing a generally planar backer plate within the tapered interior profile of the retaining ring, the backer plate having a rear face and having a front face which is closely received against the rear face of the die holder when the die holder is inserted within the retaining ring, the backer plate having an extrusion opening for receiving metal which is extruded through the orifice of the die insert;

extruding metal through the orifice of the die insert by moving the ram against the metal billet in the container;

moving the container out of contact with the extrusion die stack;

cutting a length of the extruded metal from the butt end; and moving the container back into contact with the extrusion die stack whereby the butt end remaining in the billet container forces any remaining extrusion out of the orifice in the die stack;

moving the container back out of contact with the extrusion die stack;

discarding only the butt end of the metal billet while retaining of the components of the extrusion die stack.

* * * * *